US008608337B2

(12) United States Patent
Nourishad et al.

(10) Patent No.: US 8,608,337 B2
(45) Date of Patent: Dec. 17, 2013

(54) LIGHTING FIXTURE HAVING A LOUVERED LIGHT SHIELD

(75) Inventors: Feridoun Nourishad, Irvine, CA (US); Jose Adame, Fontana, CA (US)

(73) Assignee: Koninklijke Philips N.V., Eindhoven (NL)

( * ) Notice: Subject to any disclaimer, the term of this patent is extended or adjusted under 35 U.S.C. 154(b) by 543 days.

(21) Appl. No.: 12/707,771

(22) Filed: Feb. 18, 2010

(65) Prior Publication Data

US 2011/0199760 A1 Aug. 18, 2011

(51) Int. Cl.
*F21S 4/00* (2006.01)

(52) U.S. Cl.
USPC ..... 362/225; 362/203; 362/217.09

(58) Field of Classification Search
CPC ..... F21S 4/00; F21S 48/328; F21V 13/10; F21V 11/02; F21Y 2103/00
USPC ..... 362/217.03, 217.09, 225, 296.01, 362/217.12, 351, 514, 800
See application file for complete search history.

(56) References Cited

U.S. PATENT DOCUMENTS

| | | | | |
|---|---|---|---|---|
| 188,700 | A | 3/1877 | Von Otter | |
| 1,269,548 | A | 6/1918 | Palmer | |
| 1,434,302 | A | 10/1922 | Marcotte | |
| 1,703,668 | A | 2/1929 | Grosius | |
| 1,720,437 | A | 7/1929 | Reed | |
| 1,767,590 | A | 6/1930 | Jaquith | |
| 2,065,164 | A | 12/1936 | Wetzel | |
| 2,258,353 | A | 10/1941 | Doane | |
| 2,347,672 | A | 5/1944 | Dircksen | |
| 2,761,058 | A | 8/1956 | Lipscomb | |
| 2,913,574 | A | 11/1959 | Lipscomb | |
| 3,152,766 | A | 10/1964 | Wetzel | |
| 3,760,178 | A * | 9/1973 | Miller | 362/223 |
| 4,261,028 | A | 4/1981 | Adam | |
| 4,383,290 | A | 5/1983 | Binder | |
| 4,573,111 | A | 2/1986 | Herst | |
| 4,833,575 | A | 5/1989 | Hamilton | |
| D500,882 | S | 1/2005 | Herst | |
| 7,287,878 | B2 | 10/2007 | Miller | |
| 7,349,043 | B2 | 3/2008 | Sumiyoshi | |
| D575,898 | S | 8/2008 | Tran | |
| 7,455,431 | B2 | 11/2008 | Brower | |
| 7,499,123 | B2 | 3/2009 | Sumiyoshi | |
| 7,513,634 | B2 | 4/2009 | Chen | |
| 2005/0286256 | A1 * | 12/2005 | Tran et al. | 362/404 |
| 2006/0203493 | A1 | 9/2006 | Brower | |
| 2006/0262057 | A1 | 11/2006 | Sumiyoshi | |
| 2006/0268553 | A1 | 11/2006 | Potter | |
| 2007/0121325 | A1 | 5/2007 | Barber | |
| 2008/0158479 | A1 | 7/2008 | Qi | |

FOREIGN PATENT DOCUMENTS

DE 3312987 A1 10/1984

* cited by examiner

*Primary Examiner* — Tracie Y Green

(57) ABSTRACT

A lighting fixture having a louvered light shield is provided. The louvered light shield has at least one light emitting section with a plurality of alternating ridges and troughs. A plurality of sidewalls connect the ridges and troughs. A plurality of the ridges have a light exit opening therethrough. The light exit opening enables light from a light source of the lighting fixture to exit the lighting fixture.

17 Claims, 3 Drawing Sheets

LIGHTING FIXTURE HAVING A LOUVERED LIGHT SHIELD

TECHNICAL FIELD

The present invention is directed generally to a lighting fixture having a louvered light shield. More particularly, various inventive methods and apparatus disclosed herein relate to a lighting fixture having a louvered light shield with at least one light emitting section, wherein the light emitting section has a plurality of alternating ridges and troughs and a plurality of the ridges have a light exit opening.

BACKGROUND

Longitudinally extending linear fluorescent lighting fixtures often feature blade louvers on the exposed side of the lighting fixture. The blade louvers are interposed between the fluorescent bulb(s) of the lighting fixture and the area the lighting fixture is illuminating. The blade louvers are oriented in a direction that is perpendicular to the longitudinally extending fixture. In other words, the blade louvers are oriented in a latitudinal direction that is perpendicular to the longitudinal direction of the fluorescent bulb(s) that are housed within the lighting fixture.

Such a latitudinal arrangement of blade louvers may provide good visual cut-off of the lighting element from below the fixture when viewed from the longitudinal front and back of the fixture (i.e. from either longitudinal end of the fluorescent bulbs). In other words, when walking toward the lighting fixture in line with the direction of the fluorescent bulb(s) of the lighting fixture such a latitudinal arrangement of blade louvers may provide good visual cut-off. However, such an arrangement may provide undesirable visual cut-off of the fluorescent bulb(s) when viewed from the latitudinal sides of the lighting fixture. In other words, such an arrangement may provide undesirable cut-off of the fluorescent bulbs when walking toward the lighting fixture perpendicular to the direction of the fluorescent bulb(s) of the lighting fixture.

SUMMARY

The present disclosure is directed to inventive methods and apparatus for a lighting fixture having a louvered light shield with at least one light emitting section. More particularly, various inventive methods and apparatus disclosed herein relate to a lighting fixture having a louvered light shield with at least one light emitting section, wherein the light emitting section has a plurality of alternating ridges and troughs and a plurality of sidewalls connecting the ridges and troughs. A plurality of the ridges each have at least one light exit opening. The configuration of the ridges, troughs, sidewalls and light exit openings may provide desirable visual cut-off of a light source within the lighting fixture when viewed below the lighting fixture from the latitudinal sides thereof.

Optionally, the lighting fixture may be a fluorescent lighting fixture having at least one longitudinally extending fluorescent bulb. The linear louvered light shield may be interposed between the fluorescent bulb(s) and an area to be illuminated and have at least one light emitting section therein. The light emitting section may have a corrugated cross section with a plurality of alternating ridges and troughs and sidewalls connecting the ridges and troughs. The ridges may extend inwardly toward the light source and the troughs may extend outwardly away from the light source. Both the ridges and the troughs may extend in a direction that is substantially parallel with the fluorescent bulb(s). A plurality of the ridges may have at least one longitudinally extending light exit opening therein that allows light from the fluorescent bulb(s) to exit the lighting fixture. The troughs and/or sidewalls may be at least partially opaque and the linear louvered light shield may provide desirable visual cut-off of the fluorescent bulb(s) when viewed by a user from the latitudinal sides below the lighting fixture.

Generally, in one aspect a lighting fixture for illuminating an illumination area includes at least one longitudinally extending light source and a longitudinally extending housing frame supporting and surrounding the light source. The housing frame includes a continuous longitudinally extending louvered light shield interposed between the light source and the illumination area. At least one light emitting section is in the louvered light shield. The light emitting section has a corrugated cross section and includes a plurality of alternating ridges and troughs, and a plurality of sidewalls connecting the ridges and the troughs. The ridges extend inwardly generally toward the light source and in a direction substantially parallel with the light source. A plurality of the ridges have at least one longitudinally extending light exit opening therethrough. The troughs extend outwardly generally away from the light source and in a direction substantially parallel with the light source. A plurality of the troughs are opaque. At least a portion of a plurality of the sidewalls is opaque.

In some embodiments the longitudinally extending light source is a fluorescent lamp.

In some embodiments the totality of a plurality of the sidewalls are opaque.

In some embodiments the corrugated cross section is in the general form of a rectangular wave. In some versions of those embodiments a majority of the ridges are wider than the troughs.

In some embodiments the totality of each of the sidewalls is opaque.

In some embodiments the louvered light shield is formed from an extruded sheet of metal.

In some embodiments all the ridges are coplanar with one another and all the troughs are coplanar with one another.

Generally, in another aspect a lighting fixture for illuminating an illumination area includes at least one light source and a housing frame supporting the light source. The housing frame includes a louvered light shield interposed between the light source and the illumination area. At least one light emitting section is in the louvered light shield. The light emitting section has a corrugated cross section and includes a plurality of alternating ridges and troughs, and a plurality of sidewalls connecting the ridges and the troughs. The ridges extend inwardly generally toward the light source. A plurality of the ridges have at least one light exit opening therethrough. The troughs extend outwardly generally away from the light source and in a generally parallel relationship with the ridges. The troughs are opaque and the sidewalls are opaque.

In some embodiments the corrugated cross section is in the general form of a rectangular wave. In some versions of those embodiments a majority of the ridges are wider than the troughs.

In some embodiments the louvered light shield is movably supported between a first frame side and a second frame side of the housing frame.

In some embodiments a translucent optical medium is provided over the openings. Optionally, the optical medium is transparent polycarbonate.

Generally, in another aspect a lighting fixture for illuminating an illumination area includes at least one longitudinally extending light source and a longitudinally extending housing frame supporting and surrounding the light source.

The housing frame includes a longitudinally extending louvered light shield interposed between the light source and the illumination area. At least one light emitting section is in the louvered light shield. The light emitting section has a generally rectangular wave cross section and includes a plurality of alternating ridges and troughs, and a plurality of sidewalls connecting the ridges and the troughs. The ridges extend inwardly generally toward the light source and in a direction substantially parallel with the light source. A plurality of the ridges have at least one longitudinally extending light exit opening therethrough. The troughs extend outwardly generally away from the light source and in a direction substantially parallel with the light source.

The term "light source" should be understood to refer to any one or more of a variety of radiation sources, including, but not limited to, LED-based sources (including one or more LEDs as defined above), incandescent sources (e.g., filament lamps, halogen lamps), fluorescent sources, phosphorescent sources, high-intensity discharge sources (e.g., sodium vapor, mercury vapor, and metal halide lamps), lasers, other types of electroluminescent sources, pyro-luminescent sources (e.g., flames), candle-luminescent sources (e.g., gas mantles, carbon arc radiation sources), photo-luminescent sources (e.g., gaseous discharge sources), cathode luminescent sources using electronic satiation, galvano-luminescent sources, crystallo-luminescent sources, kine-luminescent sources, thermo-luminescent sources, triboluminescent sources, sonoluminescent sources, radioluminescent sources, and luminescent polymers.

The term "lighting fixture" is used herein to refer to an implementation or arrangement of one or more lighting units in a particular form factor, assembly, or package. The term "lighting unit" is used herein to refer to an apparatus including one or more light sources of same or different types. A given lighting unit may have any one of a variety of mounting arrangements for the light source(s), enclosure/housing arrangements and shapes, and/or electrical and mechanical connection configurations. Additionally, a given lighting unit optionally may be associated with (e.g., include, be coupled to and/or packaged together with) various other components (e.g., control circuitry) relating to the operation of the light source(s).

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

In the following detailed description, for purposes of explanation and not limitation, representative embodiments disclosing specific details are set forth in order to provide a thorough understanding of the claimed invention. However, it will be apparent to one having ordinary skill in the art having had the benefit of the present disclosure that other embodiments according to the present teachings that depart from the specific details disclosed herein remain within the scope of the appended claims.

Moreover, descriptions of well-known apparatuses and methods may be omitted so as to not obscure the description of the representative embodiments. Such methods and apparatuses are clearly within the scope of the claimed invention. For example, the embodiment of the lighting fixture depicted in the Figures is shown having a housing that includes frame sides and endcaps that surround a louvered light shield. Accordingly, for illustrative purposes, the claimed invention is discussed in conjunction with such a lighting fixture. However, other housing configurations that incorporate the louvered light shield are contemplated without deviating from the scope or spirit of the claimed invention. For example, housing configurations that may incorporate the louvered light shield and omit one or more of the frame sides and/or endcaps and/or employ frame sides and/or endcaps having a different configuration than depicted herein are within the scope and spirit of the claimed invention.

Figure 1:
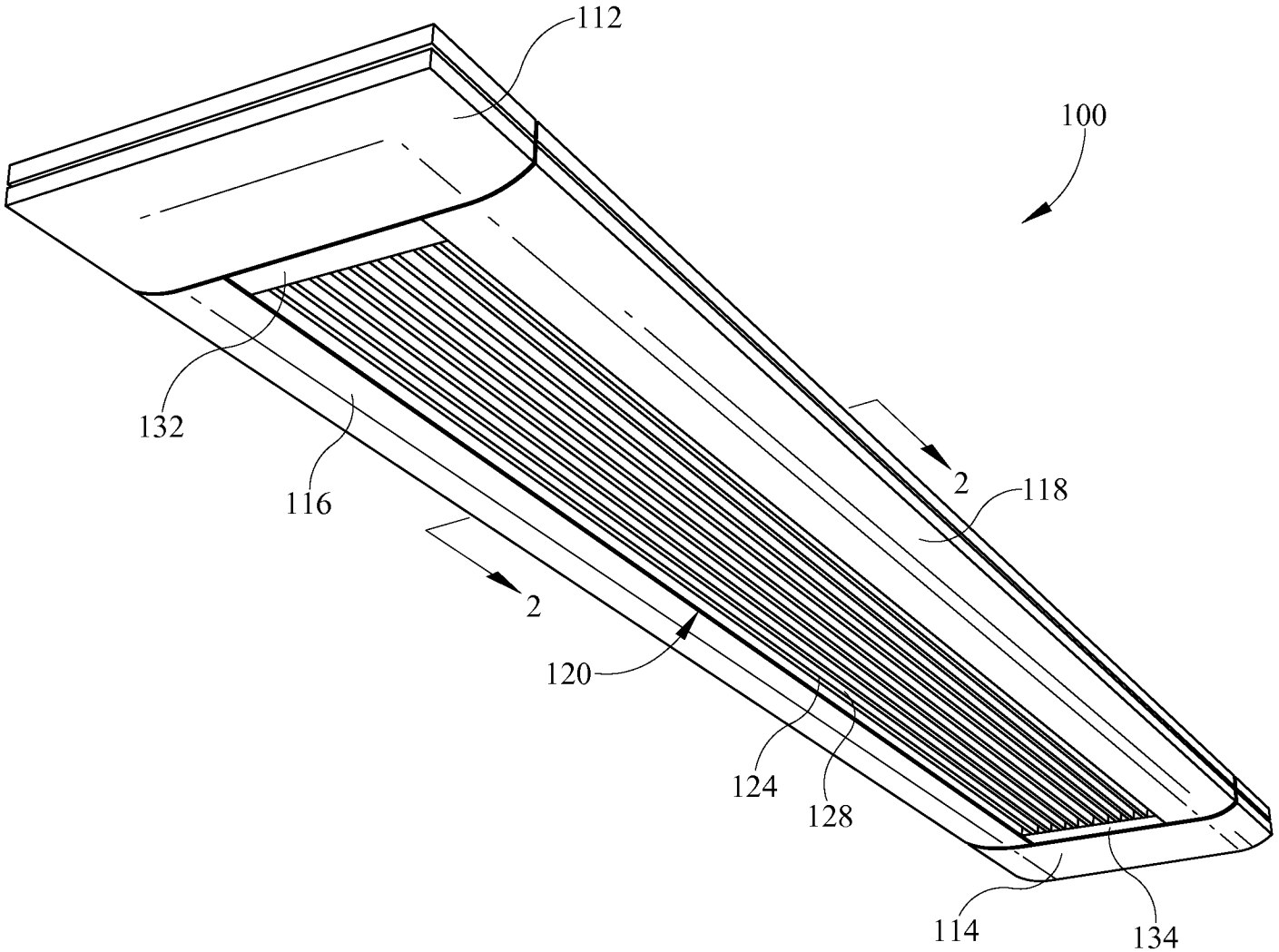
FIG. 1 illustrates a lower perspective view of an embodiment of a lighting fixture having a louvered light shield.
Figure 2:
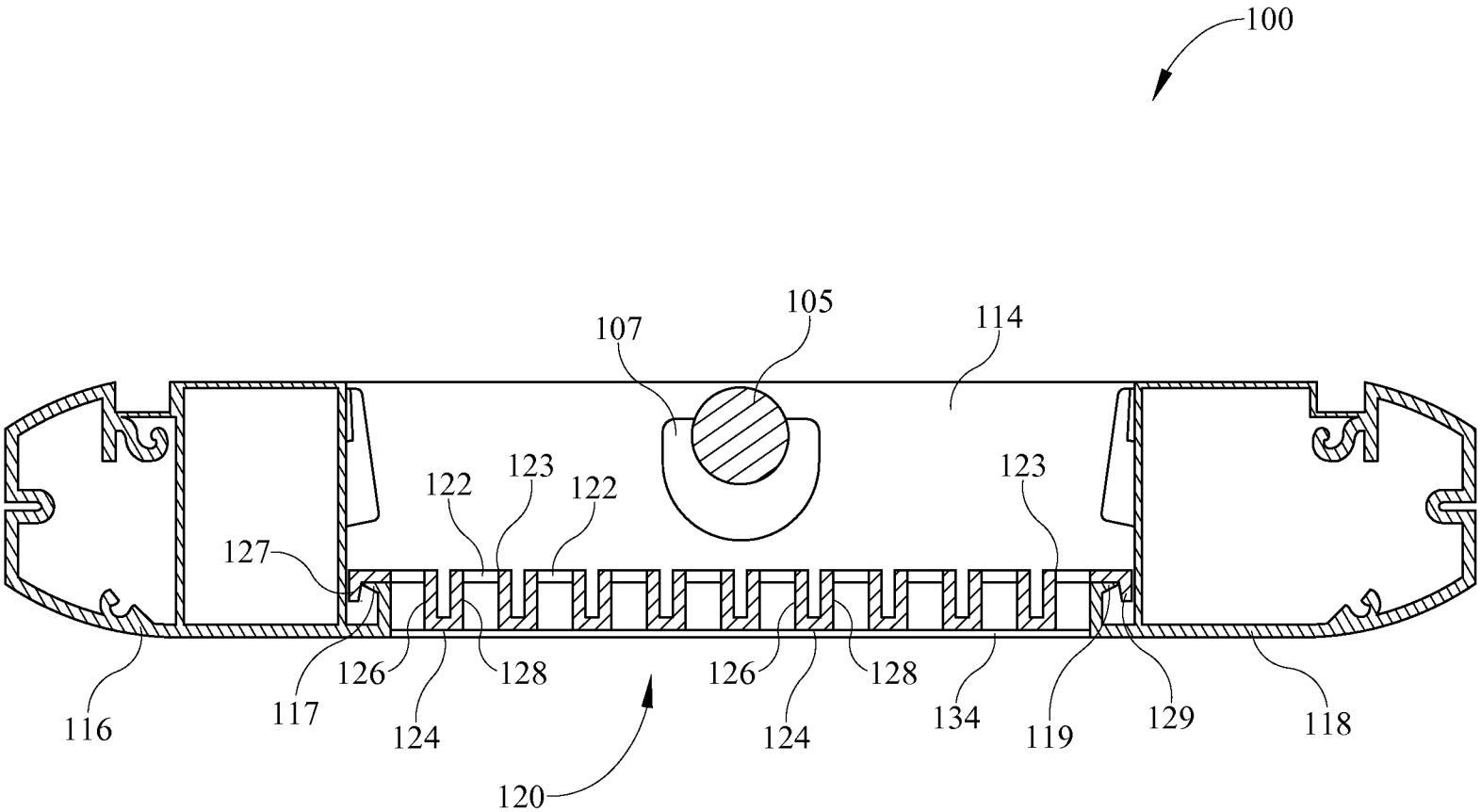
FIG. 2 illustrates a section view of the lighting fixture of FIG. 1 taken along the section line 2-2 of FIG. 1.
Figure 3:
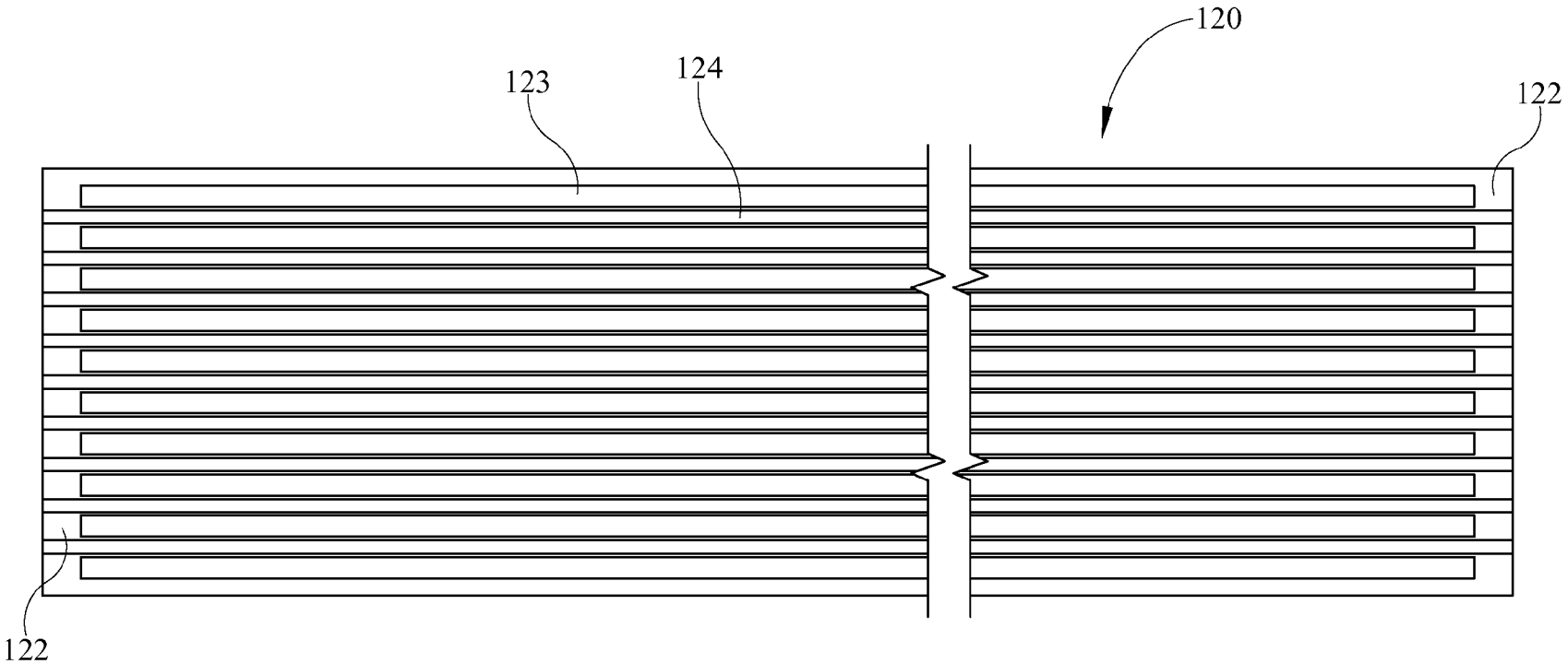
FIG. 3 illustrates a top view of the louvered light shield of the lighting fixture of FIG. 1.

Referring to FIG. 1 through FIG. 3, a first embodiment of a lighting fixture 100 is shown. The lighting fixture 100 has a housing frame that includes a longitudinally extending first frame side 116 and a longitudinally extending second frame side 118 extending between a first endcap 112 and a second endcap 114, A first end of the first frame side 116 and second frame side 118 matingly engage the first endcap 112 and an opposite end of the first frame side 116 and second frame side 118 matingly engage the second endcap 114. The first frame side 116, second frame side 118, first endcap 112, and second endcap 114 surround a fluorescent light source 105, visible in FIG. 2, The fluorescent light source 105 longitudinally extends between a socket 107 coupled to the second endcap 114 and a corresponding socket coupled to the first end cap 112. In other embodiments of the lighting fixture 100 a plurality of fluorescent light sources 105 may be provided and may optionally extend between first end cap 112 and second end cap 114. Optionally, one or more reflectors may be provided and may each be paired with one or more fluorescent light sources. For example, a reflector may be provided adjacent fluorescent light source 105 to direct light emitted thereby downwardly toward a louvered light shield 120 of the housing frame of the lighting fixture 100.

One or both of the first frame side 116 and second frame side 118 may optionally enclose one or more ballasts or power supplies for powering a light source. For example, the first frame side 116 and/or second frame side 118 may enclose one or more electronic ballast for powering at least one T5 fluorescent lamp. In other embodiments the first end cap 112 and/or second end cap 114 may enclose at least one ballast and/or at least one ballast may be located interiorly of first and second frame sides 116 and 118 and first and second end caps 112 and 114. The first frame side 116 and second frame side 118 may optionally be manufactured from an extruded metal such as, for example, aluminum. The first end cap 112 and second end cap 114 may optionally be manufactured from an stamped or extruded metal such as, for example, aluminum.

The first frame side 116 has a first frame flange 117 that extends inwardly from the remainder of the first frame side 116 and creates a gap that removably receives a first lip 127 of the louvered light shield 120. The second frame side 118 has a similar second frame flange 119 that extends inwardly from the remainder of the second frame side 118 and creates a lap that removably receives a second lip 129 of the louvered light shield 120. The first frame flange 117 and second frame flange 118 thereby support the louvered light shield 120 and enable the louvered fight shield 120 to be selectively removed for maintenance or other purposes, When supported by the first frame flange 117 and second frame flange 118 the louvered light shield 120 is interposed between the fluorescent light source 105 and an illumination area below the lighting fixture 100 that is to be illuminated by the lighting fixture 100.

The louvered light shield 120 has a plurality of alternating ridges 122 and troughs 124, and a plurality of sidewalls 126 and 128 extending between the ridges 122 and troughs 124. The ridges 122 extend inwardly generally toward the florescent light 105 and the troughs 124 extend outwardly generally away from the fluorescent light source 105. The ridges 122 and troughs 124 both extend in a direction that is substantially parallel with the direction that the fluorescent light source 105 extends. With particular reference to FIGS. 2 and 3, each of the ridges 122 has a longitudinally extending single light opening 123 therethrough. With particular reference to FIG. 3, it is illustrated that each depicted light opening 123 extends across a substantial majority of the ridge 122 through which it is provided. FIG. 3 is a top view of the linear louver shield 120. In other words, it is a view of that portion of the linear louver shield 120 that would be facing the fluorescent light source 105 when installed in the lighting fixture 100. The area within which the light openings 123 are provided generally defines a light emitting section of the louvered light shield 120. In other words, they define a section through which some light emitted by fluorescent light source 105 may exit lighting fixture 100 and illuminate a desired illumination area. As can be seen in FIG. 1, trim pieces 132 and 134 have been placed over portions of louvered light shield 120 where the light openings 123 do not extend for aesthetic purposes. The trim pieces 132 and/or 134 may optionally be omitted from lighting fixture 100 in other embodiments.

With particular reference to FIG. 2, it is illustrated that the depicted louvered light shield 120 has a corrugated cross section that is generally in the form of a rectangular wave, with the ridges 122 being of a greater width than the troughs 124. The two peripheral ridges 122 are also wider then the other ridges 122 to allow he louvered light shield 120 to rest upon the first frame flange 117 and second frame flange 119. The depicted ridges 122, troughs 124 and sidewalls 126 and 28 are all opaque. Optionally, the louvered light shield 120 may be extruded aluminum with the light exit openings 123 being pierced through the ridges 122 following extrusion. Optionally, some or all of the extruded aluminum may be coated with a less reflective material such as, for example, coated with a white paint. In use, the light exit openings 123 enable light from the fluorescent light source 105 to pass therethrough and exit the lighting fixture 100. The ridges 124 and the sidewalls 126 and 128 generally act as louver blades and provide desirable visual cut-off of the fluorescent light source 106 when viewed from the latitudinal sides of the lighting fixture. In other words, desirable visual cut-off is provided when walking toward the lighting fixture 100 in a direction perpendicular to the direction which the first and second frame sides 116 and 118 extend.

Although a specific louvered light shield 120 is depicted and described in detail herein, it is understood that one or multiple variations may be made thereto that are within the scope of the appended claims. For example in alternative embodiments less than all of the ridges 122 may be provided with light exit openings 123 therethrough. For example, the peripheral ridges maybe provided without light exit openings 123. Also, for example, in alternative embodiments multiple light exit openings 123 may be provided in a single ridge 122. For example, two or more longitudinally extending light exit openings may be provided side by or end to end single ridge 122. Also, to example, in alternative embodiments a louvered light shield 120 having a different cross section may be provided. For example, the width of one or more of the ridges 122 and/or troughs 124 may be varied, and/or the amplitude of one or more of the ridges 122 and or troughs 124 may be varied, and/or the cross section may be wholly or partially generally square waved, generally sine waved, and/or generally triangular waved Also, for example, in alternative embodiments the louvered light shield 120 may have two or more distinct light emitting sections that may be separated by a non-light emitting section such as, for example, a non-corrugated opaque section that extends longitudinally along the lighting fixture 100. Also, for example, in some embodiments all or portions the troughs 124 and/or sidewalls 126 and 128 may be non-opaque. For example, in some embodiments the sidewalls 126 may be wholly translucent. Also, for example, in some embodiments a translucent optical medium may be provided over one or more of the light exit openings 123. For example, a single transparent polycarbonate panel may be coupled to the ridges 122 and cover all of the light exit openings 123 to thereby limit dust, insects, and/or other objects from accessing the interior of the lighting fixture 100. Also, for example, in some embodiments sidewalls 126 and/or 128 may be non-perpendicular to ridges 122 and/or troughs 124. For example, the sidewalls 126 and/or 128 may be provided at a forty-five degree angle with respect to sidewalls 126 and/or 128.

The lighting fixture 100 and its housing frame have been shown and described in detail herein. However, as will be understood by one of ordinary skill in the art having had the benefit of the present disclosure, in alternative embodiments of lighting fixture 100, alternative housing frames may be utilized and incorporate a louvered light shield 120 therein. For example, housing frames may be utilized that are configured to surround non-fluorescent light sources, are configured to support one or more reflectors, that utilized non-linear (e.g., curved or multi-sided) end plates and/or frame sides, and/or that are alternatively coupled to louvered light shield 12O.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

We claim:

1. A lighting fixture for illuminating an illumination area comprising:

at least one longitudinally extending light source;

longitudinally extending housing frame supporting and surrounding said light source, said housing frame including a continuous longitudinally extending louvered light shield interposed between said light source and the illumination area;

at least one light emitting section in said louvered light shield; said light emitting section having a corrugated cross section and comprising a plurality of alternating ridges and troughs, and a plurality of sidewalls connecting said ridges and said troughs;

said ridges extending inwardly generally toward said light source and in a direction substantially parallel with said light source;

wherein a plurality of said ridges have at least one longitudinally extending light exit opening therethrough;

said troughs extending outwardly generally away from said light source and in a direction substantially parallel with said light source;

wherein a plurality of said troughs between two sidewalls of the pluality of sidewalls is opaque; and wherein at least a portion of a plurality of said sidewalls is opaque.

2. The lighting fixture of claim 1 wherein said longitudinally extending light source is a fluorescent lamp.

3. The fixture of claim 1 wherein totality of a plurality of said sidewalls is opaque.

4. The lighting fixture of claim 3 wherein said corrugated cross section is in the general form of a rectangular wave.

5. The lighting fixture of claim 4 wherein a majority of said ridges are wider than said troughs.

6. The lighting fixture of claim 5, wherein totality of each of said sidewalls is opaque.

7. The lighting fixture of claim 1 wherein said louvered light shield is formed from an extruded sheet of metal.

8. The lighting fixture of claim 1 wherein all said ridges are coplanar with one another and all said troughs are coplanar with one another.

9. A lighting fixture for illuminating an illumination area comprising:

at least one light source;

a housing frame supporting said light source, said housing frame including a louvered light shield interposed between said light source and the illumination area;

at least one light emitting section in said louvered light shield; said light emitting section having a corrugated cross section and comprising a plurality of alternating ridges and troughs, and a plurality of sidewalls connecting said ridges and said troughs;

said ridges extending inwardly generally toward said light source;

wherein a plurality of said ridges have at least one light exit opening therethrough;

said troughs extending outwardly generally away from said light source and in a generally parallel relationship with said ridge;

wherein at least one of said troughs between two sidewalls of the pluality of sidewalls is opaque; and wherein said sidewalls are opaque.

10. The lighting fixture of claim 9 wherein said light source is a flourescent lamp.

11. The lighting fixture of claim 9 wherein said corrugated cross section is in the form of a rectangular wave.

12. The lighting fixture of claim 11 wherein a majority of said ridges are wider than said troughs.

13. The lighting fixture of claim 9 wherein said louvered light shield is movably supported between a first frame side and a second frame side of said housing frame.

14. The lighting fixture of claim 9 wherein all said ridges are coplanar with one another and all said troughs are coplanar with one another.

15. The lighting fixture of claim 9 wherein said optical medium is transparent polycarbonate.

16. A lighting fixture for illuminating an illumination area comprising:

at least one longitudinally extending light source;

a longitudinally extending housing frame supporting and surrounding said, light source, said housing frame including a longitudinally extending louvered light shield interposed between said light source and the illumination area;

at least one light emitting section integrated into said louvered light shield; said light emitting section having a generally rectangular wave cross section and comprising a plurality of alternating ridges and troughs, and a plurality of sidewalls connecting said ridges and said troughs;

said ridges extending inwardly generally toward said light source and in a direction substantially parallel with said light source;

wherein plurality of said ridges have at least one longitudinally extending light exit opening therethrough;

said troughs extending outwardly generally away from said light source and in a direction substantially parallel with said light source, wherein a plurality of said troughs between two sidewalls of the pluality of sidewalls is opaque; and wherein at least a portion of a plurality of said sidewalls is opaque.

17. The lighting fixture of claim 16 wherein a majority of said ridges is wider than said troughs.

* * * * *